United States Patent [19]

Bauer

[11] 4,185,777

[45] Jan. 29, 1980

[54] FLUIDIC SPRAY DEVICE OF SIMPLE CONSTRUCTION

[75] Inventor: Peter Bauer, Germantown, Md.

[73] Assignee: Bowles Fluidics Corporation, Silver Spring, Md.

[21] Appl. No.: 900,475

[22] Filed: Apr. 27, 1978

Related U.S. Application Data

[63] Continuation of Ser. No. 792,452, Apr. 29, 1977, abandoned, which is a continuation-in-part of Ser. No. 691,084, May 28, 1976, abandoned.

[51] Int. Cl.[2] ..... B05B 1/02

[52] U.S. Cl. ..... 239/394; 239/590; 239/596; 239/600

[58] Field of Search ..... 239/101, 102, 596, 600, 239/394, 590; 137/833, 841

[56] References Cited

U.S. PATENT DOCUMENTS

| | | | |
|---|---|---|---|
| 2,974,880 | 3/1961 | Stewart et al. | 239/600 X |
| 3,266,508 | 8/1966 | Zilberfarb | 137/833 |
| 3,376,881 | 4/1968 | Godwin | 137/834 X |
| 3,507,275 | 4/1970 | Walker | 128/173 |
| 3,767,125 | 10/1973 | Gehres | 239/600 X |
| 3,999,713 | 12/1976 | Lindsey | 239/600 X |

*Primary Examiner*—John J. Love
*Attorney, Agent, or Firm*—Rose & Edell

[57] ABSTRACT

A spray device comprises a fluidic element formed as recesses in a first surface of one member and sealed by abutting a second surface of another member against the first surface and pressing the two members together in a forced-fit arrangement. In order to prevent leakage of fluid, the power nozzle of the element is spaced from the edges of said surface, and the supply fluid is conducted to the nozzle via a passage which intersects the nozzle from out of the plane of the element.

27 Claims, 16 Drawing Figures

FIG.8
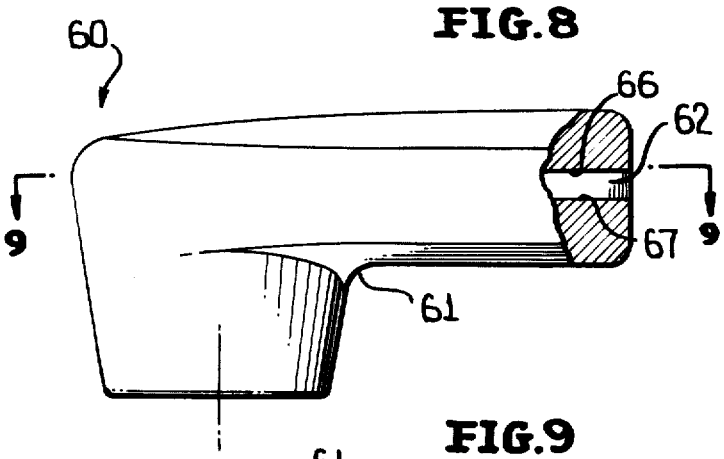
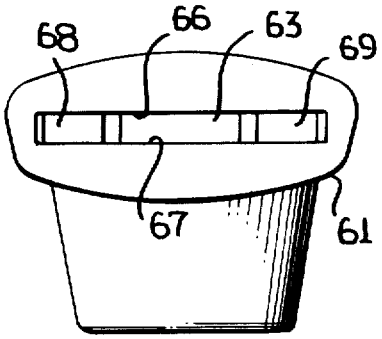
FIG.12
FIG.9
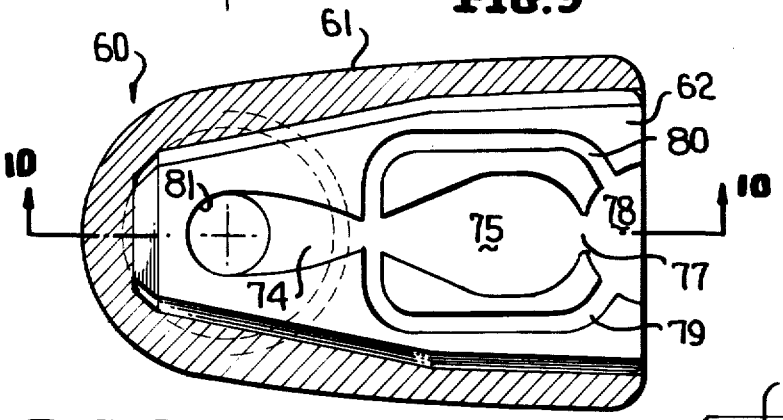
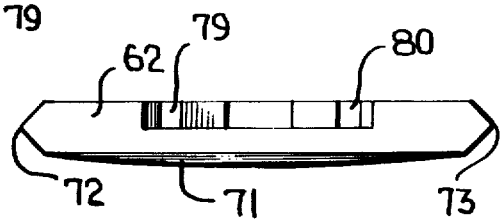
FIG.13
FIG.10
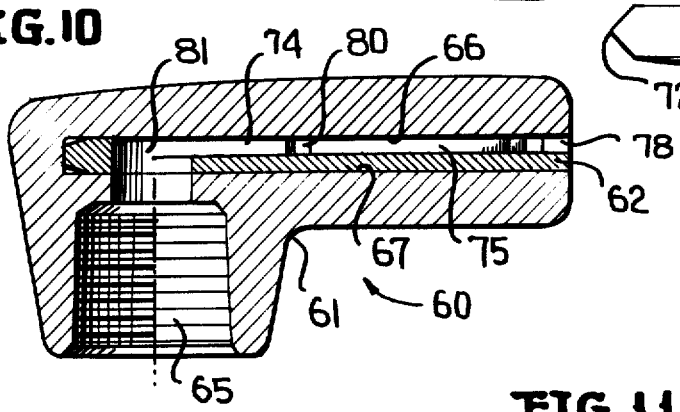
FIG.11
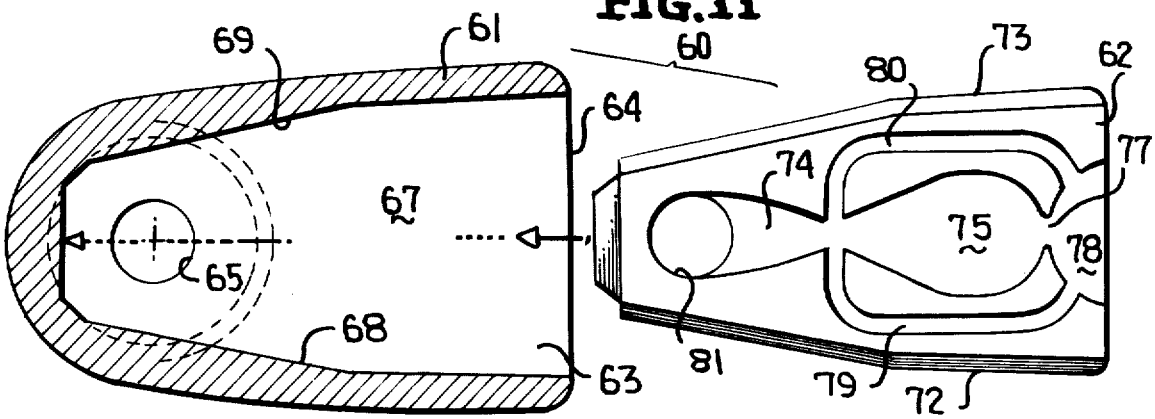

FIG. 14
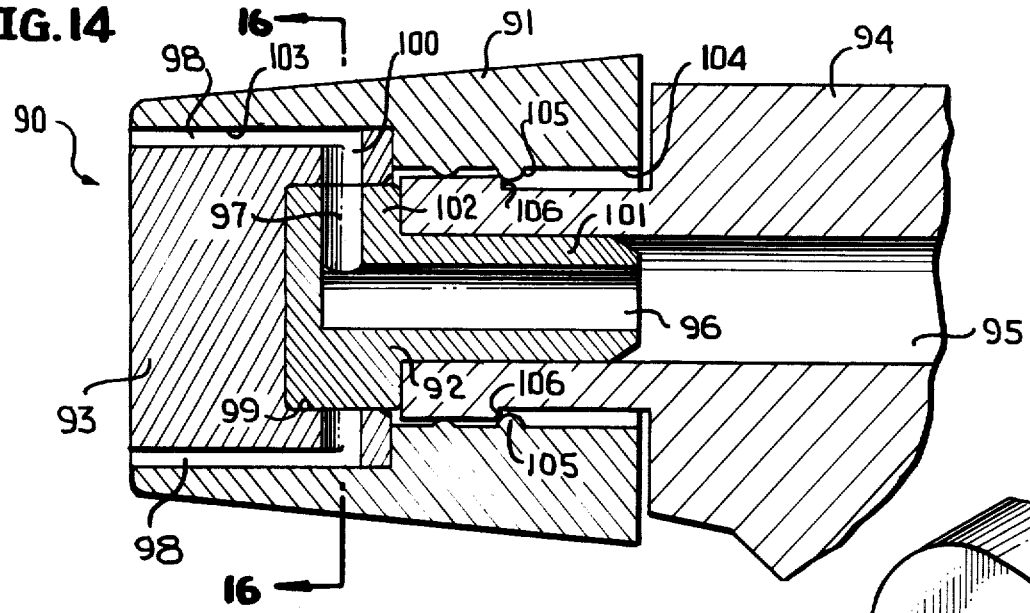
FIG. 15
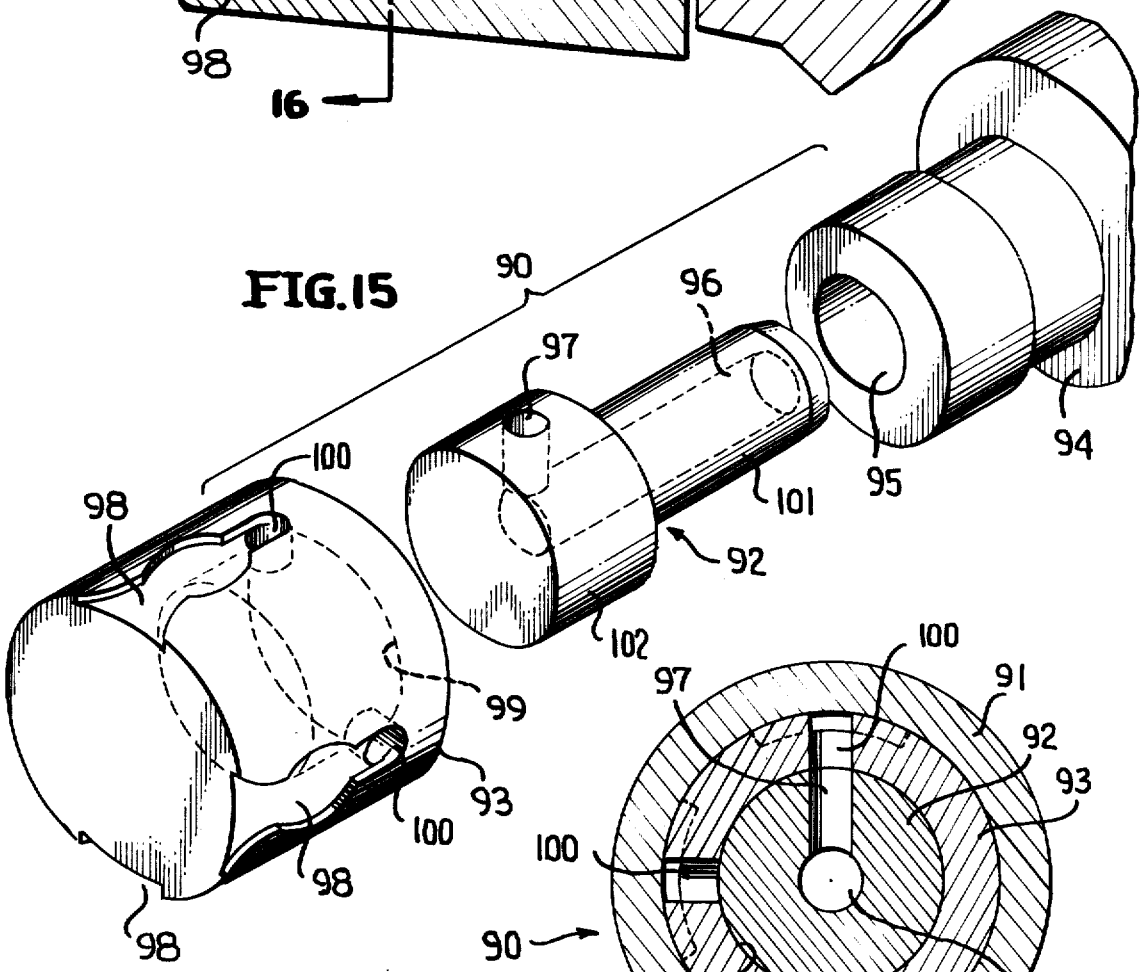
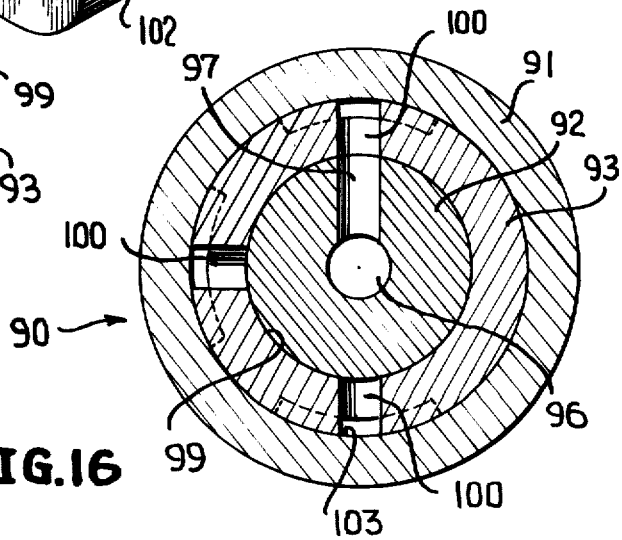
FIG. 16

FLUIDIC SPRAY DEVICE OF SIMPLE CONSTRUCTION

CROSS-REFERENCE TO RELATED APPLICATION

This is a continuation, of application Ser. No. 792,452 filed Apr. 29, 1977, now abandoned, which is a Continuation-in-Part of Ser. No. 691,084, filed May 28, 1976, now abandoned.

BACKGROUND OF THE INVENTION

The present invention relates to fluidic spraying devices and particularly to an efficient, inexpensive arrangement for fabricating such devices.

It is now known that fluidic elements, particularly fluidic oscillators, have particular utility as nozzles and spraying devices in general. Examples of this may be found in U.S. Pat. No. 3,973,558 and in U.S. Patent Application Ser. No. 618,208, filed Sept. 30, 1975. When so used, it is important that the fluidic nozzles be suitable for mass production at the lowest possible cost without sacrifice of nozzle operating characteristics.

It is known that a fluidic element can be formed as a series of recesses in an element surface, which recesses are then sealed by a cover surface adhesively secured to the element surface. Supply fluid for such an element is generally received from a passage oriented along the element surface (i.e. in the plane of the element), the passage having its ingress at an edge of the element surface. This type of element is costly to manufacture because of the fabrication step requiring application of adhesive. In addition, location of the ingress at the edge of the element plane results in considerable leakage along the abutting edges of the element and cover surfaces.

It is an object of the present invention to provide a fluidic spray device constructed in a manner which eliminates the aforementioned disadvantages. More specifically, it is an object of the present invention to provide a fluidic spray device which can be quickly and efficiently mass produced and in which the aforementioned leakage problems are eliminated.

SUMMARY OF THE INVENTION

In accordance with the present invention a fluidic spray device is formed as recesses in an element surface of a body member. The recesses are sealed by an abutting surface of a cover member which is continually pressed against the element surface, thereby eliminating the need for adhesive material. The continuous pressing together of the two surfaces to form a pressure seal is preferably accomplished by force-fitting the two members together in a suitably contoured housing.

The fluidic element power nozzle or inlet is positioned remote from the edges of the element surface and receives supply fluid under pressure from a passage extending through either the body member or cover member at an angle to the element plane. The ingress opening is thus removed from the adjoining edges of the element surface and the cover surface, thereby eliminating leakage along those edges.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein:

FIG. 8 is a side view in elevation and partial section of another embodiment of the present invention;

FIG. 9 is a view in section taken along lines 9—9 of FIG. 8;

FIG. 10 is a view in section taken along lines 10—10 of FIG. 9;

FIG. 11 is an exploded view in plan of the view in FIG. 9;

FIG. 12 is a front end view in elevation of the embodiment of FIG. 8 with the insert removed;

FIG. 13 is a front end view of the insert removed from the embodiment of FIG. 8;

FIG. 14 is a side view in section of another spray nozzle embodiment of the present invention;

FIG. 15 is an exploded view in perspective of the embodiment of FIG. 14; and

FIG. 16 is a view in section taken along lines 16—16 of FIG. 14.

DESCRIPTION OF PREFERRED EMBODIMENTS

Figure 1:
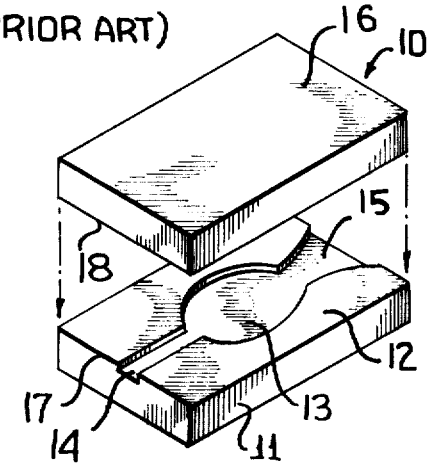
FIG.1 (PRIOR ART)
FIG. 1 is an exploded view in perspective of a prior art fluidic spray device.

Referring to FIG. 1 of the accompanying drawings, a prior art spray device 10 is shown as a fluidic element formed as a series of recesses in the element surface 12 of an element body member 11. The recesses may be formed by etching, photo-engraving or other suitable process; preferably, however, if the body member 11 is made of plastic the entire body member may be molded with the recesses as part thereof. The fluidic element itself is generally designated by the reference numeral 13 and includes an inlet 14, which extends to edge 17 of element surface 12 to receive pressurized fluid, and an outlet 15 for issuing the fluid in a specific spray pattern.

A cover plate 16 includes an underside cover surface (not shown) which is placed against the element surface 12 of member 11 to seal the fluidic element 13. A suitable adhesive material is generally employed to maintain the body member 11 and cover plate 16 together. The application of the adhesive material, and the hardening time and procedure for that material, add significantly to the cost of the overall spray device 10.

In use, spray device 10 is subject to leakage of supply fluid along mutually abutting edges 17 and 18 of the body member 11 and cover plate 16, respectively. Specifically, supply fluid applied at inlet 14 tends to leak along the joint between the body member and cover plate, resulting in both waste and annoyance to the user.

Figure 2:
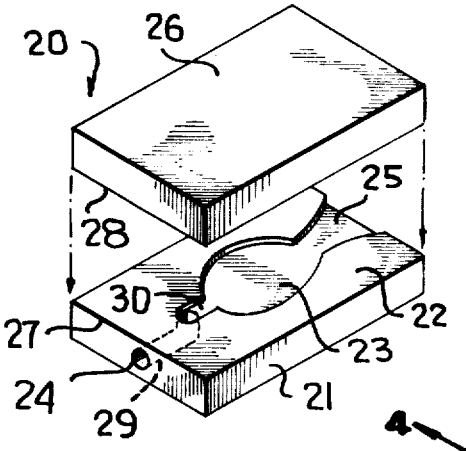
FIG. 2 is an exploded view in perspective of a fluidic spray device constructed in accordance with the principles of the present invention.
Figure 3:
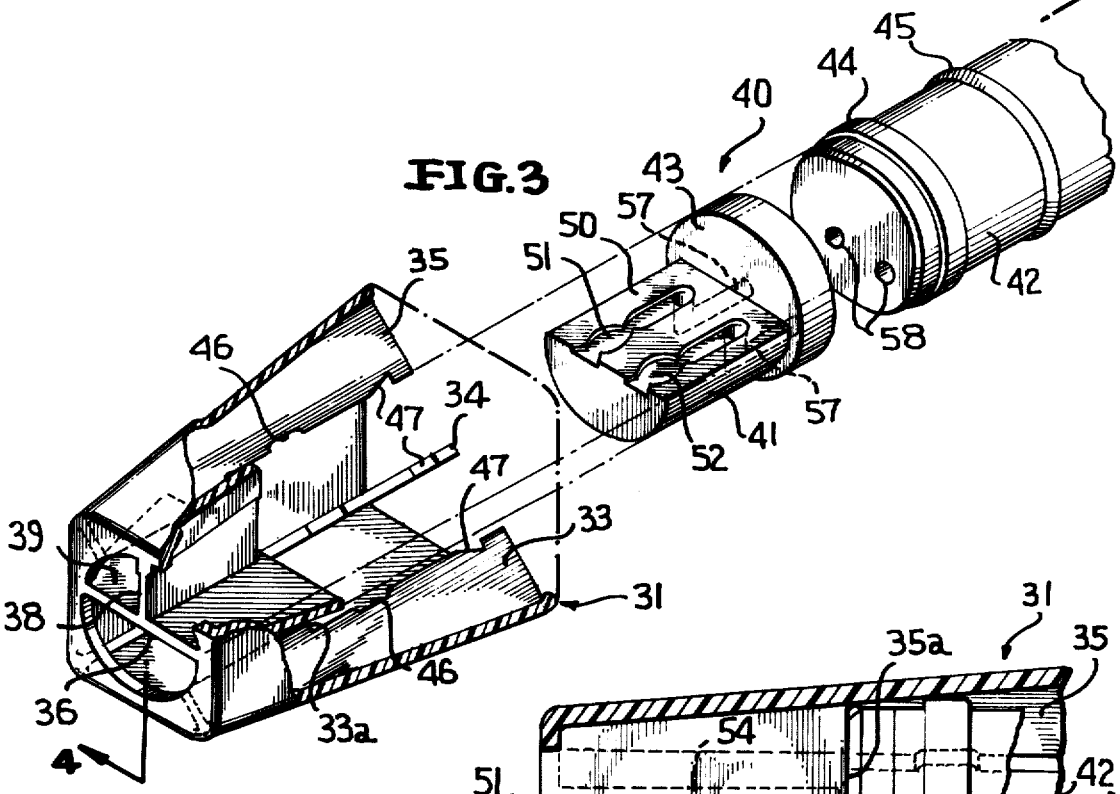
FIG. 3 is an exploded view in perspective of a preferred embodiment of the present invention.
Figure 7:
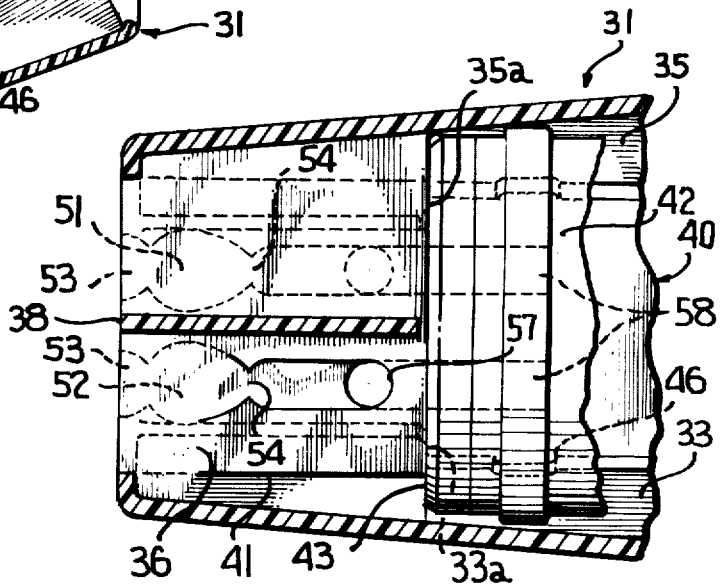
FIG. 7 is a view in section taken along lines 7—7 of FIG. 5.
Figure 4:
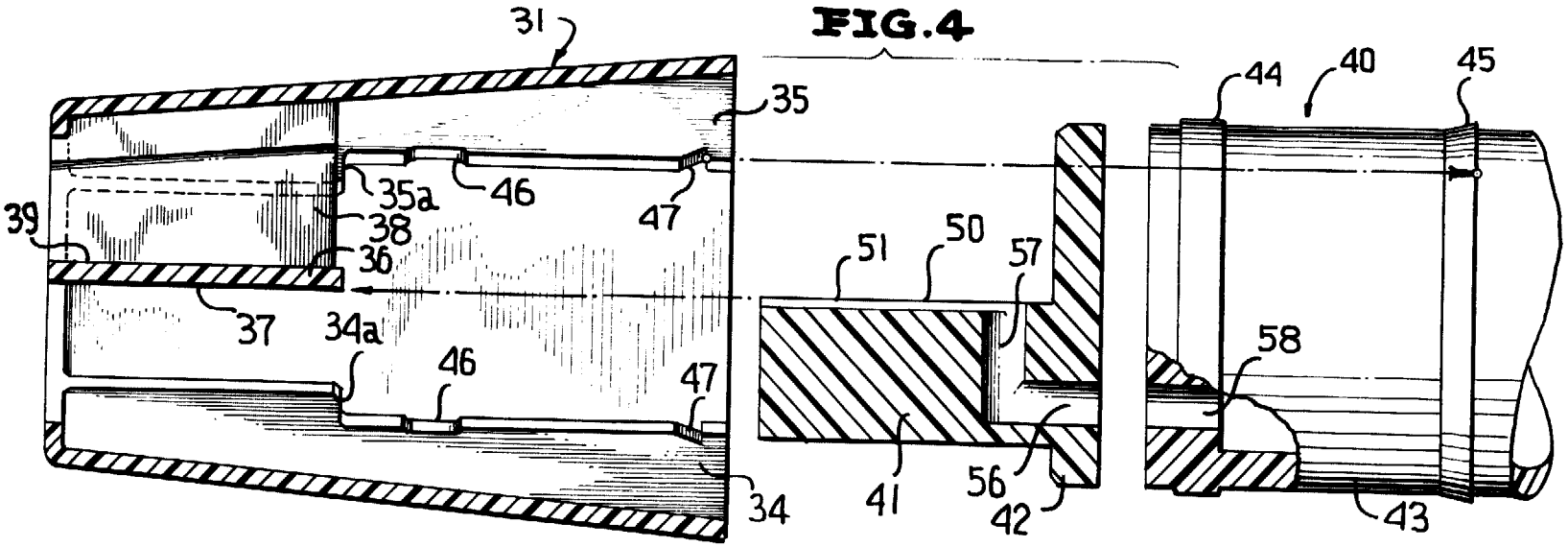
FIG. 4 is a view in section taken along lines 4—4 of FIG. 3.
Figure 5:
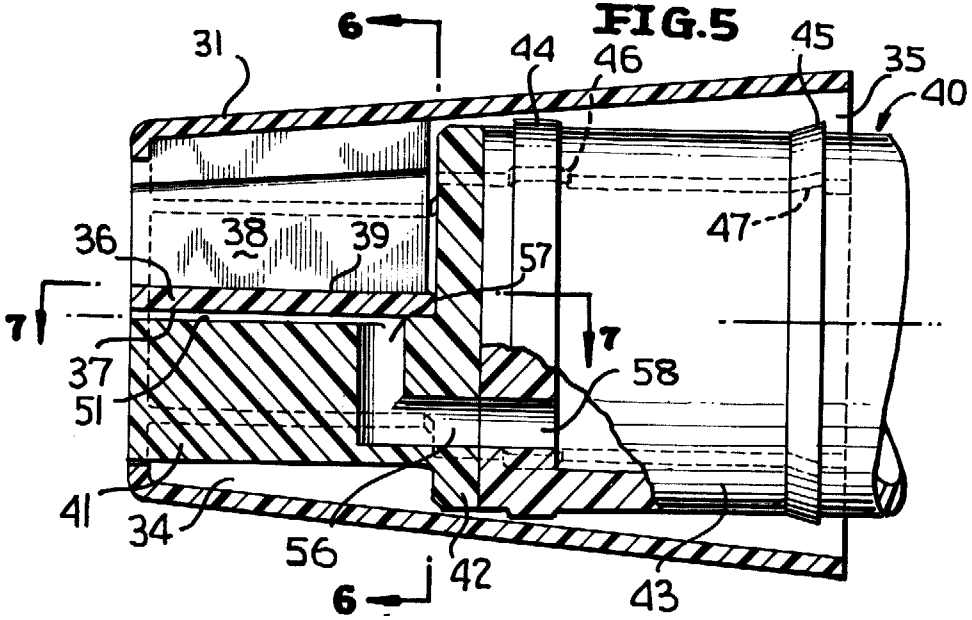
FIG. 5 is a view in section of the assembled spray device of FIG. 4.
Figure 6:
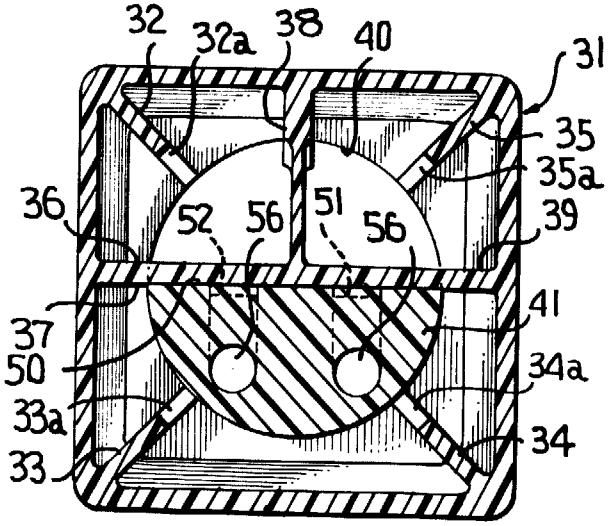
FIG. 6 is a view in section taken along lines 6—6 of FIG. 5.

The spray device 20 of FIG. 2 eliminates the cost and operational deficiencies of device 10 described above. Spray device 20 includes a body member 21 having an element surface 22 in which recesses are formed to define fluidic element 23. The latter includes a spray outlet 25 and an inlet 24. A cover plate 26 includes an undersurface (not shown) which abuts element surface 22 to seal the fluidic element.

An important distinction between spray devices 10 and 20 resides in the fact that inlet 24 feeds applied supply fluid to the fluidic element from a location out of the plane of surface element 22 via passage 29. Specifically, inlet 24 is an ingress opening to passage 29 and is spaced from the abutting edges 27 and 28 of the body member 21 and cover plate 26, respectively. Passage 29 extends through body member 21 to intersect the power nozzle 30 of the fluidic element in a direction from out of the plane of element surface 22. By thus supplying fluid to fluidic element 23 from a location out of the element plane, leakage along edges 27, 28 is avoided.

It should be noted that the illustrated orientation and position of inlet 24 and passage 29 are not crucial. For example, inlet 24 may be located directly below power nozzle 30 and passage 29 would extend perpendicularly through body member 21. Likewise, inlet 24 and passage 29 may be defined in cover plate 26 rather than in body member 21. The important point is that inlet 24 not be located at the abutting edges between the cover plate and body member and, therefore, that passage 29 intersect power nozzle 30 at an angle relative to the element plane 22.

A second important feature of the present invention is the fact that cover plate 26 and body member 21 are not held together by adhesive; nor are they fused or otherwise permanently joined. Instead, the cover plate and body member are compressively forced together by the housing in which they are located. Such housing is not illustrated in FIG. 2 but is adequately illustrated in the preferred embodiment of FIGS. 3 through 16.

Referring to FIGS. 3–7, one preferred embodiment of the spray device of the present invention includes a housing 31 having the general configuration of a hollow regular trapezohedron which narrows in a downstream flow direction along the device. Interiorly of housing 31 there are four ribs 32, 33, 34, 35, which extend radially from the four inner corners of the housing toward the longitudinal center line thereof over substantially the entire housing length (i.e. in the flow direction). The downstream sections of ribs 32–35 (i.e. the section proximate the outlet end of the device) comprise four edges which define longitudinal lines along an imaginary cylinder. The upstream sections of ribs 32–35, which are set back from the downstream sections by shoulders 32*a*, 33*a*, 34*a*, 35*a*, comprise four similar edges which define longitudinal lines along another imaginary cylinder having a larger diameter than the first. The edges of the upstream sections of ribs 32–35 are notched for purposes to be described below.

A substantially flat sealing member 36 extends across one dimension of the downstream end of housing 31 and includes a substantially planar sealing surface 37, the plane of surface 37 being positioned to include the longitudinal center line of the housing. Positional rigidity for sealing member 36 in the dimension normal to its plane is provided by a web 38 extending perpendicularly from surface 39 (opposite sealing surface 37) to the inner wall of housing 31.

A two-piece insert for housing 31 includes as one piece a body member 40 having a semi-cylindrical downstream section 41 and a short, generally cylindrical upstream flange 42 of larger diameter. A hollow upstream second insert piece 43 is also generally cylindrical and of the same diameter as flange 42. The diameter of semi-cylindrical piece 41 is equal to the diameter of the imaginary cylinder defined by the downstream edges of ribs 32–35, thereby permitting piece 41 to be force-fitted into the downstream end of housing 31 between surface 37 and ribs 33 and 34. The diameter of cylindrical flange 42 and upstream piece 43 likewise matches the diameter of the imaginary cylinder defined by the upstream edges of ribs 32–35, thereby permitting a force-fit engagement of flange 42 and piece 43 by all four ribs. The outer surface of piece 43 includes one or more annular projections 44, 45 which cooperate with notches 46, 47 in the edges of ribs 32–35 to provide a detent action which precludes inadvertent longitudinal displacement of the insert 40 relative to housing 31. When fully inserted, the downstream side of flange 42 abuts the upstream edge of sealing member 36, the sealing member itself being forced against the flat surface 50 of piece 41.

The flat surface 50 of insert piece 41 has one or more fluidic elements 51, 52 defined therein. In the preferred embodiment these fluidic elements are formed as part of the integrally molded plastic insert piece 41; it should be noted, however, that other techniques may be employed. The molding approach is, of course, less time-consuming and less costly. Each fluidic element includes an outlet region 53 from which pressurized fluid may be issued in a specified spray pattern, the configuration of which depends upon the nature and configuration of the fluidic element. For example, elements 51, 52 may be fluidic oscillators wherein pressurized fluid applied to the element is formed into a fluid jet by nozzle 54 and caused to oscillate or sweep back and forth in the plane of the fluidic element. The sweeping jet is issued from outlet region 53 through the open downstream end of housing 31 whereupon the jet breaks up into a fan-shaped pattern of droplets (in the case of liquid), particulates (in the case of a particulate-laden gas), or gas slugs (in the case of a gas). In any case, surface 37 seals the top of the fluidic elements.

Pressurized supply fluid is provided to each fluidic element 51, 52 from the interior of hollow upstream piece 43. Specifically, for each fluidic element there is an inlet port 56 defined in the upstream wall of flange 42. Inlet port 56 communicates with the power nozzle 54 of the fluidic element via a fluid passage 57 which extends into and through the body of downstream insert piece 41. Importantly, passage 57 communicates with the fluid element 51, 52 from out of the plane of the element (i.e. at an angle relative to surface 50). Therefore, the point at which the supply fluid enters the recessed fluidic element is removed from the edges of element surface 50 and sealing surface 37, thereby avoiding the leakage problem that tends to occur at those edges.

Fluid is supplied to inlet port 56 through a suitably provided opening 58 through the downstream wall of insert piece 43. Specifically, pressurized liquid is delivered to the interior of insert piece 42 and egresses through openings 58 into inlet ports 56. This, of course, assumes proper rotational alignment of inlet port 56 and openings 58. In this regard it is to be noted in the illustrated embodiment that: (a) insert piece 41 is mutually rotatable relative to insert piece 43 about the central longitudinal axis of housing 31, with the upstream wall surface of flange 42 being in abutting, rotatably slidable relation with the downstream wall of insert piece 43;

and (b) inlet ports 56 and openings 58 are equal in size and are disposed at equal radial displacements from the central longitudinal axis of the housing 31. From the foregoing it will be seen that, for different rotational positions of insert piece 41 relative to insert piece 43, the following alternative conditions are possible: (i) both openings 58 are aligned with respective inlet ports 56 so that both fluidic elements 51 and 52 can receive fluid and are operational; (ii) either one of the inlet ports 56 at a time may be aligned with an opening 58 so that only the corresponding fluidic element is operational; or (iii) neither of the inlet ports 56 is aligned with an opening 58, whereby neither fluidic element is operational.

Insert piece 43 is normally rotationally rigid by being secured to a container or pump structure (not shown). Mutual rotation between insert pieces 41 and 43 is therefore effected by rotating housing 31 relative to the container or pump structure about the housing longitudinal axis. Suitable detents may be provided to define the various operating positions of insert piece 41 relative to piece 43; such detents between mutually rotatable members are well known.

The spray device as described is simple to manufacture in that injection-molded parts are simply force-fitted together into a reliable fluid-sealing engagement; no adhesive or binding step is required. Flow directed to the element from out of the element plane avoids leakage along the edges of the abutting members.

The particular configuration illustrated and described should not be considered limiting. For example, as mentioned briefly above, the passage 57 may be defined through either the element body member 41 or the sealing member 36. Likewise, the fluid element itself can be defined in the outer cylindrical wall of member 41 and sealed by a suitably cylindrically contoured abutting surface. Such an embodiment is illustrated in FIGS. 14–16 hereof and is described subsequently. The materials employed are preferably a hard plastic which is slightly deformable under the compressive forces exerted when insert 40 is force-fitted into housing 31; an example of such a plastic is polypropylene, but other plastics are similarly appropriate.

Among the possible configurations would be a housing in which the internal radial ribs are tapered, being narrower at the outlet end, and wherein a two-piece insert (element body and sealing body) are similarly tapered so that upon being forced into the housing the two insert pieces are wedged together by the ribs. Other configurational variations will be obvious to those skilled in the art.

Referring to FIGS. 8 through 13 of the drawings, another spray nozzle 60 constructed in accordance with the present invention, is illustrated in a two-piece configuration. A housing 61 constitutes one of the two nozzle pieces; an insert 62 constitutes the other. Housing 61 has a generally flat cavity 63 defined therein, which cavity terminates in a wide, generally rectangular opening 64 to a surface at the forward end (to the right in FIGS. 8–11) of the housing. A bore 65 is defined part-way into housing 61 from the bottom thereof and communicates with cavity 63 in a direction out of the plane of the cavity. The particular direction of this communication illustrated in FIG. 10 is perpendicular; however, substantially any direction from out of the cavity plane is sufficient. Bore 65 may be partially threaded, as shown in FIG. 10, or otherwise configured to receive a tube or hose or other means of conveying pressurized fluid into housing 61.

Insert 62 is a generally flat member adapted to be forced or pressed into cavity 63 and securely retained therein by the pressure exerted by the housing cavity walls on the insert. For this purpose it is assumed that the material from which the housing is fabricated is a solid plastic which deforms slightly under pressure. More particularly, cavity 63 has a top wall 66 and bottom wall 67 which are spaced by a distance substantially equal to the thickness of insert 62 between the insert top surface 70 and bottom surface 71. (In the preferred embodiment bottom surface 71 is somewhat bowed, making insert 62 somewhat thicker along its middle for reason to be discussed subsequently.) The sidewalls 68 and 69 are likewise spaced by a distance substantially equal to the width of insert 62 between its edges 72 and 73. (In the preferred embodiment the insert may be a few thousandths of an inch wider than the cavity 63, again for reasons to be described subsequently.) The insert and cavity taper along their lengths, being wider at the forward end and narrowing toward the rearward end. The taper may be gradual or, as shown, effected in plural discrete sections which are slightly angled toward one another.

A fluidic oscillator is defined in insert 62 as a plurality of recessed portions in top surface 70. Specifically, the oscillator includes a power nozzle 74 directed forwardly and into an interaction region 75. The forward end of the interaction region terminates in an exit throat 77 which is aligned with power nozzle 74 and serves as an inlet to an outlet region 78. A right control passage 79 communicates between the right side of outlet region 78 and the right side of interaction region 75 proximate power nozzle 74. A similar left control passage 80 extends between the left side of outlet region 78 and the left side of interaction region 75 proximate the power nozzle. Elements 74 through 80 are all defined as recesses, of equal or varying depths, into top surface 70 of insert 62. An inlet port 81 is defined entirely through the thickness of insert 62 into communication with power nozzle 74. Inlet port 81 is positioned to be aligned with bore 65 of housing 61 when insert 62 is fully inserted into slot 63. In this manner pressurized fluid can be delivered through bore 65 and port 81 to power nozzle 74 of the oscillator. Operation of the particular oscillator shown proceeds in the manner described in U.S. Pat. No. 3,973,558 and need not be described herein. It is important to state that a wide variety of fluidic oscillators can be employed in place of the specific oscillator illustrated and described herein, and that the mode of operation of any particular oscillator is not of itself important to the present invention. The end result, however, is that a jet of fluid is swept back and forth across outlet region 78 and issues out through opening 64. The issued jet forms a spray pattern of a nature which depends on the type of fluid, the pressure, the size of the oscillator, etc., and which is useful in a wide variety of spray applications, including showers, oral irrigators, agricultural sprays, sprays for containerized liquids pressurized by hand pumps or aerosol, vehicle windshield washers, etc.

As mentioned above, bottom surface 71 is bowed somewhat so that the insert 62 is thicker along its longitudinal middle than along its sides; in fact, the bowing renders the middle of the insert thicker than the spacing between top and bottom walls 66 and 67 of cavity 63. Thus, when insert 62 is pressed or forced into cavity 63, walls 66 and 67 are spread slightly and in turn exert a higher pressure along the middle of the insert. The oscillator formed in top surface 70, being substantially centered between edges 72, 73 of the insert, is therefore very tightly sealed against wall 66 of cavity 63. In addition, it is noted that the edges 72 and 73 in the illustrated embodiment of insert 62 are chamfered. As mentioned above, the width of insert 62 between edges 72 and 73 may be wider than slot 63 by a few thousandths of an inch. The chamfering of the edges 72 and 73 facilitates deformed expansion of the insert within the cavity, exerting a still greater sealing pressure against the oscillator. This chamfering is an optional feature as is the bowing of the insert. The important characteristic of the embodiment of FIGS. 8–13 is that an insert can be force-fitted into a cavity so that a fluidic oscillator formed in a surface of the insert, or in a surface of the cavity, can be sealed solely by the pressure exerted by the forced fit engagement.

It should be noted that cavity 63 and insert 62, although shown substantially planar, may be arcuate, angled, or otherwise configured, depending upon the spray pattern desired. Likewise, oscillators may be defined in both the top and bottom surfaces of the insert or in the top and bottom walls of the cavity. The only limitation is that the fluidic oscillator, whichever surface or surfaces it is defined in, is sealed by the abutting surface(s) through the pressure exerted by the force fit.

Still another embodiment of the present invention is illustrated in FIGS. 14–16. This embodiment is a three-piece nozzle 90, including a hollow housing 91, an insert 92 and a body member 93. As partially illustrated in FIG. 14, pressurized fluid is delivered to nozzle 90 from a pump 94 having a generally cylindrical outlet passage 95. Stem 92 has an elongated stem portion 101 which is force-fitted into outlet passage 95 in sealing relationship. A head portion 102 of insert 92 is of larger diameter than stem 101 and limits the extent of insertion of the stem into passage 95. A bore 96 extends longitudinally through the elongated stem 101 into communication with another bore 97 which extends radially to the outer extremity of the head portion 102.

Body member 93 is generally cylindrical and has a cylindrical recess 99 at its rearward end (to the right in FIG. 14) into which the head portion 102 of insert 92 is inserted in rotary slidable relationship. A plurality of fluidic oscillators 98 are defined at angularly spaced locations in the outer surface of the forward end of body member 93. Oscillators 98 are formed as recesses in the cylindrical outer surface of body member 93 with the outlet ends of the oscillators co-planar with the forward surface of the body member. Pressurized fluid is delivered to each oscillator 98 through respective supply passages 100 defined radially through body member 93 at recess 99. Each passage 100 is in the form of a bore which can be aligned with bore 97 in head 102 when body member 93 is properly rotated relative to insert 92. Thus by proper angular positioning of head member 93 relative to insert 92, pumped fluid can be individually supplied to any one of the oscillators 98.

Housing 91 is a hollow member having an interior wall with a forward section 103 and a rearward section 104. The forward section 103 is contoured to match the cylindrical periphery of body member 93 which is force-fitted into the forward end of the housing. Forward section 103 of the interior wall thus serves as a sealing surface for each of the oscillators 98, much in the same manner as surface 66 seals the oscillator in FIGS. 8–14 described above. More specifically, the force-fit engagement between housing 91 and body member 93 urges wall section 103 against the cylindrical outer surface of body member 93 to seal all of the oscillators defined in that surface.

Rearward section 104 of the interior wall of housing 91 is of smaller diameter than forward section 103 and includes an annular inwardly projecting portion 105. Rearward section 104 extends over the forward spout of pump 94 such that annular portion 105 locks the housing in place over the pump spout by engaging a suitably provided annular shoulder 106 on the spout.

In assembling nozzle 90, insert 93 is force-fitted into passage 95 of pump 94 until the head portion 102 abuts the pump spout. Insert 93 is positioned so that bore 97 is oriented in a known direction (e.g. directed upward). Body member 93 is then force-fitted into the forward end of housing 91 to seal the oscillators 98. The housing 91 is then snap-fitted onto pump 94 with head portion 102 inserted into recess 99. The housing 91 and body member 93 are then rotatable together relative to head portion 102 and bore 97 to align the appropriate inlet 100 of the desired oscillator 98 with bore 97. Actuation of the pump 94 then forces pressurized fluid through passage 95 and bores 96 and 97, to the desired oscillator.

It should be noted that the oscillators 98 could be formed in inner wall section 103 of housing 91 rather than in the outer surface of body member 93. Moreover, inlets 100 and bore 97 can be directed other than solely radially outward; it is important, however, that these passages and bores be such that entry of pressurized fluid into oscillators 98 is from out of the plane of the oscillator.

Materials employed for the embodiments of FIGS. 8–16 require the same considerations mentioned above for the embodiment of FIGS. 3–7.

While I have described and illustrated specific embodiments of my invention, it will be clear that variations of the details of construction which are specifically illustrated and described may be resorted to without departing from the true spirit and scope of the invention as defined in the appended claims.

I claim:

1. A liquid spray apparatus comprising:

a substantially rigid body member having a first surface and being fabricated of solid material which is slightly deformable when subjected to compression forces exerted substantially normal to said first surface, at least part of said first surface having a predetermined contour;

a substantially rigid sealing member disposed immediately adjacent said body member, said sealing member having a sealing surface which abuts said first surface and is contoured to match said predetermined contour;

a fluidic element in the form of recessed flow passages defined as a cutaway portion of said predetermined contour in said first surface and sealed by said sealing surface, said fluidic element including: a nozzle configured to receive liquid under pressure and issue a jet of said liquid; means responsive to issuance of said jet for sweeping said jet in the plane of said element; wherein said nozzle is located remote from all edges of said first surface; an outlet for issuing said swept jet exteriorly of said body and sealing members;

an inlet passage adapted to receive liquid under pressure and conduct same to said nozzle, said inlet passage having a downstream end which communicates with said nozzle from a location out-of-plane with respect to said fluidic oscillator and out of communication with the edges of said first surface; and wherein said body member and sealing member are tightly press-fitted together, one inside the other, to force said body member and said sealing member together, normal to said first surface, under sufficient pressure to tightly engage said body member and sealing member while slightly deforming said body member and effecting a positive liquid seal for said fluidic element along the abutting first and sealing surfaces.

2. The spray apparatus according to claim 1 wherein said sealing member comprises a housing into which said body member is force-fitted such that said housing exerts a compressive force urging said body member and sealing member together along said first and sealing surfaces and tightly engaging said body member in said housing.

3. The spray apparatus according to claim 1 wherein said sealing member comprises a hollow housing having a longitudinal axis and a plurality of ribs projecting generally radially toward said longitudinal axis, and wherein said body member is force fit between at least two of said ribs and said sealing member such that said at least two ribs compressively urge said body member against said sealing member along said first and sealing surfaces.

4. The spray apparatus according to claim 3 further comprising: a second fluidic element defined in said first surface; a second inlet passage adapted to receive liquid under pressure and conduct same to said second fluidic element; and control means for alternatively and selectively directing flow through the first-mentioned inlet passage, said second inlet passage and both said inlet passages.

5. The spray apparatus according to claim 4 wherein said fluidic elements are fluidic oscillators.

6. The spray apparatus according to claim 1 further comprising: a second fluidic element defined in said first surface; a second inlet passage adapted to receive liquid under pressure and conduct same to said second fluidic element; and control means for alternatively and selectively directing flow through the first-mentioned inlet passage, said second inlet passage and both said inlet passages.

7. The spray apparatus according to claim 1 wherein said fluidic element is a fluidic oscillator.

8. The liquid spray apparatus according to claim 2 wherein said housing is a hollow member having a generally cylindrical inner surface serving as said sealing surface, and wherein said first surface of said body member is cylindrical and of substantially the same diameter as said inner surface, such that upon force-fitting said body member into said housing said inner surface tightly engages said first surface and seals said fluidic element.

9. The liquid spray apparatus according to claim 8 wherein a plurality of fluid elements are defined in said cylindrical first surface, said fluidic elements being angularly displaced from one another, each fluid element having one of said inlet passages communicating with the fluidic element from out of plane of the element, said apparatus further including a stationary fluid supply passage, said body member being rotatable with said housing to plural positions, said supply passage being aligned with a different element inlet passage in each of said positions.

10. The spray apparatus according to claim 2 wherein said body member is a generally flat slab-like insert, and wherein said housing has a flat cavity defined therein which is open at one end, said insert being force-fit into said cavity, and wherein said inlet passage is defined through said housing.

11. The spray apparatus according to claim 2 wherein:

said housing has a cavity defined therein, one wall of said cavity serving as said sealing surface;

said body member is an insert which is force-fitted into said cavity with said first surface abutting said sealing surface, the dimensions of said cavity and insert being such that the force-fit exerts sufficient force between the first and sealing surfaces to tightly engage said body member in said housing.

12. The spray apparatus according to claim 1 wherein said body member is a flat slab-like insert, wherein said housing has a similarly flat cavity defined therein which is open at one end to receive said body member, the dimensions of said cavity and body member being such that said body member must be forced into said cavity through said one open end as the body member slightly deforms the cavity walls.

13. The spray nozzle according to claim 1 wherein said body member is a flat slab-like insert, wherein said housing has a similarly flat cavity defined therein which is open at one end to receive said body member, and wherein the dimension of said insert normal to said first surface is slightly greater proximate the central portion of that surface than the corresponding dimension of said cavity, whereby said cavity and said insert are each slightly deformed by one another when said insert is forced into said cavity.

14. The spray nozzle according to claim 13 wherein said insert includes edges which are chamfered so as to be narrower than corresponding dimensions of said cavity.

15. A spray apparatus comprising:

a substantially rigid body member having a cavity defined therein;

a substantially rigid insert force-fitted into said cavity;

said cavity having a first surface defining a part of the boundary of said cavity;

said insert having a second surface which abuts said first surface;

a fluidic element in the form of recessed flow passages defined as channel portions of one of said first and second surfaces and sealed by the other of said first and second surfaces, said fluidic element comprising a fluidic oscillator, including: a nozzle configured to receive liquid under pressure and issue a jet of said liquid; means responsive to issuance of said jet for cyclically sweeping said jet transversely of its flow direction; wherein said nozzle is located remote from all edges of said one of said surfaces;

wherein the force-fit between said body member and said insert is sufficiently tight normal to said first surface to positively urge said first and second surfaces together in sealing engagement and to preclude said insert from being readily removed from said cavity;

an inlet passage defined in one of said body member and insert for conducting pressurized fluid to said nozzle of said fluidic element from a location out of plane with respect to said fluidic oscillator and out of commuication with the edges of said one of said surfaces; and an outlet opening defined in said one of said first and second surfaces for conducting outflow of said fluidic element from said apparatus in the plane of said one surface.

16. The apparatus according to claim 15 wherein said cavity and insert are generally cylindrical.

17. The apparatus according to claim 15 wherein said insert is a flat wafer-like member.

18. The apparatus according to claim 15 wherein said insert has a length and width substantially greater than its depth, said fluidic element being recessed depthwise into said first surface.

19. The spray apparatus according to claim 15 wherein said insert is a flat slab-like member, wherein said body member has a similarly flat cavity defined therein which is open at one end to receive said insert, the dimensions of said cavity and insert being such that said insert must be forced into said cavity through said one open end as the insert slightly deforms the cavity walls.

20. The spray nozzle according to claim 15 wherein said insert is a flat slab-like member, wherein said body member has a similarly flat cavity defined therein which is open at one end to receive said insert, and wherein the dimension of said insert normal to said first surface is slightly greater proximate the central portion of that surface than the corresponding dimension of said cavity, whereby said cavity and said insert are each slightly deformed by one another when said insert is forced into said cavity.

21. A spray device comprising:

a substantially rigid hollow housing member having first and second opposed interior surfaces;

a substantially rigid insert member having a third surface, said insert being tightly wedged into said housing between said first and second surfaces so as to be slightly deformed and firmly engaged in said housing solely by compressive forces applied to the insert by said first and second surfaces normal to said third surface;

fluid oscillator means defined as recesses in one of said surfaces, said recesses being sealed by another of said surfaces against which the surface with said recesses abuts, said fluid oscillator comprising: a nozzle configured to receive fluid under pressure and issue a jet of said fluid; means responsive to issuance of said jet for cyclically sweeping said jet transversely of the nominal jet flow direction; wherein said nozzle is located remote from all edges of said one of said surfaces;

an inlet passage, defined in at least one of said housing and insert members, for conducting fluid under pressure to said fluid oscillator from a location out of plane with respect to said fluidic oscillator and out of communication with the edges of said one of said surfaces and an outlet opening defined in at least one of said housing and insert members for issuing outflow of said fluid oscillator from said device in the plane of said one surface.

22. The device according to claim 21 wherein said first, second and third surfaces are substantially parallel planar surfaces.

23. The device according to claim 21 wherein said first and second surfaces comprise opposite semi-cylindrical portions of a cylindrical surface, and said third surface is cylindrical.

24. The spray apparatus according to claim 21 wherein said insert is a flat slab-like member, wherein said housing has a similarly flat cavity defined therein which is open at one end to receive said body member, the dimensions of said cavity and insert being such that said insert must be forced into said cavity through said one open end as the insert slightly deforms the cavity walls.

25. The spray nozzle according to claim 21 wherein said insert is a flat slab-like member, wherein said housing has a similarly flat cavity defined at least partially between said first and second surfaces and which is open at one end to receive said insert, and wherein the dimension of said insert normal to said third surface is slightly greater proximate the central portion of that surface than the corresponding dimension between said first and second surfaces, whereby said cavity and said insert are each slightly deformed by one another when said insert is forced into said cavity.

26. A spray apparatus comprising:

a substantially rigid body member having a cavity defined therein;

a substantially rigid insert force-fitted into said cavity;

said cavity having a first surface defining a part of the boundary of said cavity;

said insert having a second surface which abuts said first surface;

a fluidic element defined as a recessed part of one of said first and second surfaces and covered by the other of said first and second surfaces;

wherein the force-fit between said body member and said insert is sufficiently tight normal to said first surface to positively urge said first and second surfaces together in sealing engagement and to preclude said insert from being readily removed from said cavity:

an inlet passage defined in one of said body member and insert for conducting pressurized fluid to said fluidic element; and an outlet opening defined in said one of said first and second surfaces for conducting outflow of said fluidic element from said apparatus in the plane of said one surface;

wherein said insert is a flat slab-like member, wherein said body member has a similarly flat cavity defined therein which is open at one end to receive said insert, and wherein the dimension of said insert normal to said first surface is slightly greater proximate the central portion of that surface than the corresponding dimension of said cavity, whereby said cavity and said insert are each slightly deformed by one another when said insert is forced into said cavity; and wherein said insert includes edges which are chamfered so as to be narrower than corresponding dimensions of said cavity.

27. A spray device comprising:

a substantially rigid hollow housing member having first and second opposed interior surfaces;

a substantially rigid insert member having a third surface, said insert being tightly wedged into said housing between said first and second surfaces so as to be slightly deformed and firmly engaged in said housing solely by compressive forces applied to the insert by said first and second surfaces normal to said third surface;

fluid oscillator means defined as recesses in one of said surfaces, said recesses being sealed by another of said surfaces against which the surface with said recesses abuts;

an inlet passage, defined in at least one of said housing and insert members, for conducting fluid under pressure to said fluid oscillator; and an outlet opening defined in at least one of said housing and insert members for issuing outflow of said fluid oscillator from said device in the plane of said one surface;

wherein said insert is a flat slab-like member, wherein said housing has a similarly flat cavity defined at least partially between said first and second surfaces and which is open at one end to receive said insert, and wherein the dimension of said insert normal to said third surface is slightly greater proximate the central portion of that surface than the corresponding dimension between said first and second surfaces, whereby said cavity and said insert are each slightly deformed by one another when said insert is forced into said cavity; and wherein said insert includes edges which are chamfered so as to be narrower than corresponding dimensions of said cavity.

* * * * *